US006968149B2

(12) United States Patent
Takahashi et al.

(10) Patent No.: US 6,968,149 B2
(45) Date of Patent: Nov. 22, 2005

(54) IMAGE FORMING APPARATUS AND METHOD OF CLEANING THE SAME

(75) Inventors: Masashi Takahashi, Yokohama (JP); Takeshi Watanabe, Ichikawa (JP); Shinji Aoki, Sunto-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/385,713

(22) Filed: Mar. 12, 2003

(65) Prior Publication Data

US 2004/0179880 A1 Sep. 16, 2004

(51) Int. Cl.[7] ..... G03G 15/00; G03G 21/00; G03G 15/16

(52) U.S. Cl. ..... 399/347; 399/349; 399/299; 399/149; 399/302; 399/150

(58) Field of Search ..... 399/299, 149, 399/150, 123, 343, 344, 347, 349, 350, 354, 302; 400/679, 719; 101/416.1, 423

(56) References Cited

U.S. PATENT DOCUMENTS

| | | | | |
|---|---|---|---|---|
| 5,616,386 A | * | 4/1997 | Okada et al. | 428/40.1 |
| 6,108,502 A | * | 8/2000 | Kawada et al. | 399/159 |
| 6,389,246 B1 | | 5/2002 | Nakamura et al. | |
| 6,507,724 B2 | | 1/2003 | Tamura et al. | |
| 6,537,714 B2 | | 3/2003 | Kaya et al. | |
| 6,611,672 B2 | | 8/2003 | Aoki et al. | |
| 6,620,566 B1 | | 9/2003 | Yamauchi | |
| 6,687,483 B2 | | 2/2004 | Chen et al. | |
| 6,757,512 B2 | | 6/2004 | Miyawaki et al. | |

FOREIGN PATENT DOCUMENTS

| | | | | |
|---|---|---|---|---|
| JP | 58-105273 A | | 6/1983 | |
| JP | 58209773 A | * | 12/1983 | G03G/21/00 |
| JP | 5-341643 A | | 12/1993 | |
| JP | 6-110343 A | | 4/1994 | |
| JP | 08160812 A | * | 6/1996 | G03G/21/00 |
| JP | 11-249452 A | | 9/1999 | |
| JP | 2000122450 A | * | 4/2000 | G03G/15/16 |
| JP | 2000-155501 A | | 6/2000 | |
| JP | 2001117460 A | * | 4/2001 | G03G/21/10 |
| JP | 2001175099 A | * | 6/2001 | G03G/15/16 |
| JP | 2002372896 A | * | 12/2002 | G03G/21/00 |

* cited by examiner

*Primary Examiner*—Daniel J. Colilla
(74) *Attorney, Agent, or Firm*—Foley & Lardner LLP

(57) ABSTRACT

There is provided a simply structured, cleanerless image forming apparatus capable of suppressing occurrence of filming without significant remodeling.

An image forming apparatus 100 according to the present invention comprises a plurality of image forming units 100*a*, 100*b*, 100*c*, and 100*d* for forming toner images of corresponding colors on photoconductor drums 3*a*, 3*b*, 3*c*, and 3*d* according to a cleanerless system. These image forming units respectively have adhered toner film cleaners 1*a*, 1*b*, 1*c*, and 1*d* each of which touches a surface of the photoconductor and mechanically cleans the surface at every cleaning timing for cleaning the surface of the photoconductor. The adhered toner film cleaner does nothing during image formation, but cleans the photoconductor surface only at cleaning timing when the image formation is complete for the specified number of sheets. Accordingly, it is possible to decrease filming without affecting the photoconductor's life.

22 Claims, 6 Drawing Sheets

IMAGE FORMING APPARATUS AND METHOD OF CLEANING THE SAME

BACKGROUND OF THE INVENTION

1. Field of the Invention

The present invention relates to an electrophotographic image forming apparatus and more particularly to an image forming apparatus and a cleaning method thereof, wherein the image forming apparatus comprises a plurality of image forming units each forming a toner image of a corresponding color on a photoconductor in accordance with a cleanerless system.

2. Description of the Related Art

There is well known the transfer technology based on corona charging to a photoconductor as a conventional transfer technology for electrophotographic image forming apparatuses. However, this technology generates noxious ozone. To solve this, contact-based transfer technologies were proposed as transfer technologies not generating noxious ozone. For example, Jpn. Pat. Appln. Laid-Open Publication No. 6-110343 discloses the technology that uses a semi-conductive transfer belt and a transfer roller provided at the rear of the transfer belt and applies a transfer bias to the transfer roller to transfer images.

For example, the following systems are applicable to an image apparatus that uses yellow (Y), magenta (M), cyan (C), and black (Bk) toners, forms corresponding toner images, and overlays them to form a color image.

(1) The system that overlays 4-color toner images on one photoconductor and transfers the overlaid toner images onto recording paper at a time.

(2) The transfer drum system that holds recording paper on a transfer drum and forms 4-color toner images by means of four rotations of the transfer drum.

(3) The system that temporarily forms 4-color toner images on an intermediate transferrer and transfers the formed toner images onto recording paper at a time (e.g., Jpn. Pat. Appln. Laid-Open Publication No. 11-249452).

(4) The 4-drum tandem system that arranges four photoconductor drums in parallel and forms 4-color toner images while recording paper passes through these photoconductor drum once (e.g., Jpn. Pat. Appln. Laid-Open Publication No. 2000-155501).

The above-mentioned 4-drum tandem image forming apparatus (example (4) above) forms 4-color toner images while recording paper once passes through respective image forming units including the 4-drum tandem photoconductor drums. It is possible to form a color image in one quarter of the time needed for the other systems that repeat a similar process after completing an image formation process for each color and returning control to the image formation position. Accordingly, the use of this 4-drum tandem system is very advantageous to acceleration of the image formation. The image forming units employ the cleanerless system that removes a cleaning apparatus from the photoconductor drum (e.g., Jpn. Pat. Appln. Laid-Open Publication No. 5-341643). The system contributes to cost saving of the image forming apparatus, life prolongation and miniaturization of the photoconductor, and decrease in the toner consumption.

While the above-mentioned cleanerless 4-drum tandem image forming apparatus is advantageous to the process acceleration, miniaturization, and decrease in the toner consumption, the cleanerless design causes toner remaining on the photoconductor to be adhered to the surface of the photoconductor (filming) and generates white dots on a formed image, thus degrading the image quality. For this reason, the invention disclosed in Jpn. Pat. Appln. Laid-Open Publication No. 2000-155501 generates a speed difference between the photoconductor drum and the transfer belt at a cleaning timing to use this frictional force for cleaning. However, this solution complicates operations and makes the settings difficult. A simpler solution is demanded.

SUMMARY OF THE INVENTION

The present invention has been made in consideration of the foregoing. It is therefore an object of the present invention to provide a simply structured, cleanerless 4-drum tandem image forming apparatus capable of suppressing occurrence of filming without significantly remodeling the image forming apparatus and to provide a cleaning method thereof.

In order to overcome the above-mentioned problems, the present invention provides an image forming apparatus comprising a plurality of image forming units each forming a toner image of a corresponding color on a photoconductor according to a cleanerless system, wherein each of the image forming units has an adhered toner film cleaner which touches a surface of the photoconductor and mechanically cleans the surface at every cleaning timing for cleaning the surface of the photoconductor.

This configuration can easily prevent filming because it just needs to attach the adhered toner film cleaner to each image forming unit of the 4-drum tandem cleanerless image forming apparatus. The adhered toner film cleaner does nothing during image formation and performs cleaning only at cleaning timing. Therefore, it is possible to prevent occurrence of filming by scarcely damaging the photoconductor surface and maintaining the photoconductor's long life characteristic.

According to the present invention, the photoconductor of each of the image forming units may be configured to cooperate with a transfer roller and overlappingly transfer the formed toner images on recording paper supplied by the transport belt. Further, the photoconductor of each of the image forming units may be configured to cooperate with a transfer roller, overlappingly transfer the formed toner images on an intermediate transfer belt, and then collectively transfer overlappingly-transferred toner images on recording paper.

The present invention provides an image forming apparatus comprising a plurality of image forming units each forming a toner image of a corresponding color on a photoconductor according to a cleanerless system, wherein the photoconductor of each of the image forming units cooperates with a transfer roller and overlappingly transfers the formed toner images on recording paper supplied by the transport belt, the apparatus further comprising: a filming prevention power supply capable of overlaying AC voltage for filming prevention on transfer-use DC voltage applied to the transfer roller at every cleaning timing for cleaning the surface of the photoconductor.

According to this configuration, the filming prevention power supply makes AC voltage to vibrate toner remaining on the photoconductor at every cleaning timing for cleaning the photoconductor surface. Agitated by this vibration, the remaining toner is separated from the photoconductor surface and can easily move to recording paper, preventing occurrence of filming.

The present invention provides an image forming apparatus comprising a plurality of image forming units each forming a toner image of a corresponding color on a photoconductor according to a cleanerless system, wherein the photoconductor of each of the image forming units cooperates with a transfer roller, overlappingly transfers the formed toner images on an intermediate transfer belt, and then collectively transfers overlappingly-transferred toner images to recording paper, the apparatus further comprising: a filming prevention power supply capable of overlaying AC voltage for filming prevention on transfer-use DC voltage applied to the transfer roller at every cleaning timing for cleaning the surface of the photoconductor.

The present invention provides an image forming apparatus comprising a plurality of image forming units each forming a toner image of a corresponding color on a photoconductor according to a cleanerless system, wherein toner used for forming the toner image comprises a particle containing wax. In this case, it is preferable that the particle is formed spherically.

The present invention provides an image forming apparatus comprising a plurality of image forming units each forming a toner image of a corresponding color on a photoconductor according to a cleanerless system, wherein toner used for forming the toner image contains an additive whose melting point is 100° C. or higher.

The present invention provides an image forming apparatus comprising a plurality of image forming units each forming a toner image of a corresponding color on a photoconductor according to a cleanerless system and further comprising a wax layer forming unit, wherein the plurality of image forming units forms a toner image using toner with no wax added, and the wax layer forming unit uses toner with no color pigment contained and forms a wax layer on recording paper before forming an image on recording paper.

Further, the present invention provides a cleaning method for an image forming apparatus comprising a plurality of image forming units each forming a toner image of a corresponding color on a photoconductor according to a cleanerless system, wherein the photoconductor of each of the image forming units cooperates with a transfer roller and overlappingly transfers the formed toner images on recording paper supplied by the transport belt, the method comprising the step of: feeding a cleaning sheet instead of the recording paper at every cleaning timing for cleaning a surface of the photoconductor.

DESCRIPTION OF THE PREFERRED EMBODIMENTS

Embodiments of the present invention will be described with reference to the accompanying drawings. In these drawings, movement directions of various rollers and a belt are marked with arrows that indicate rotation directions of various rollers and a running direction of the belt.

(Embodiment 1)

Figure 1:
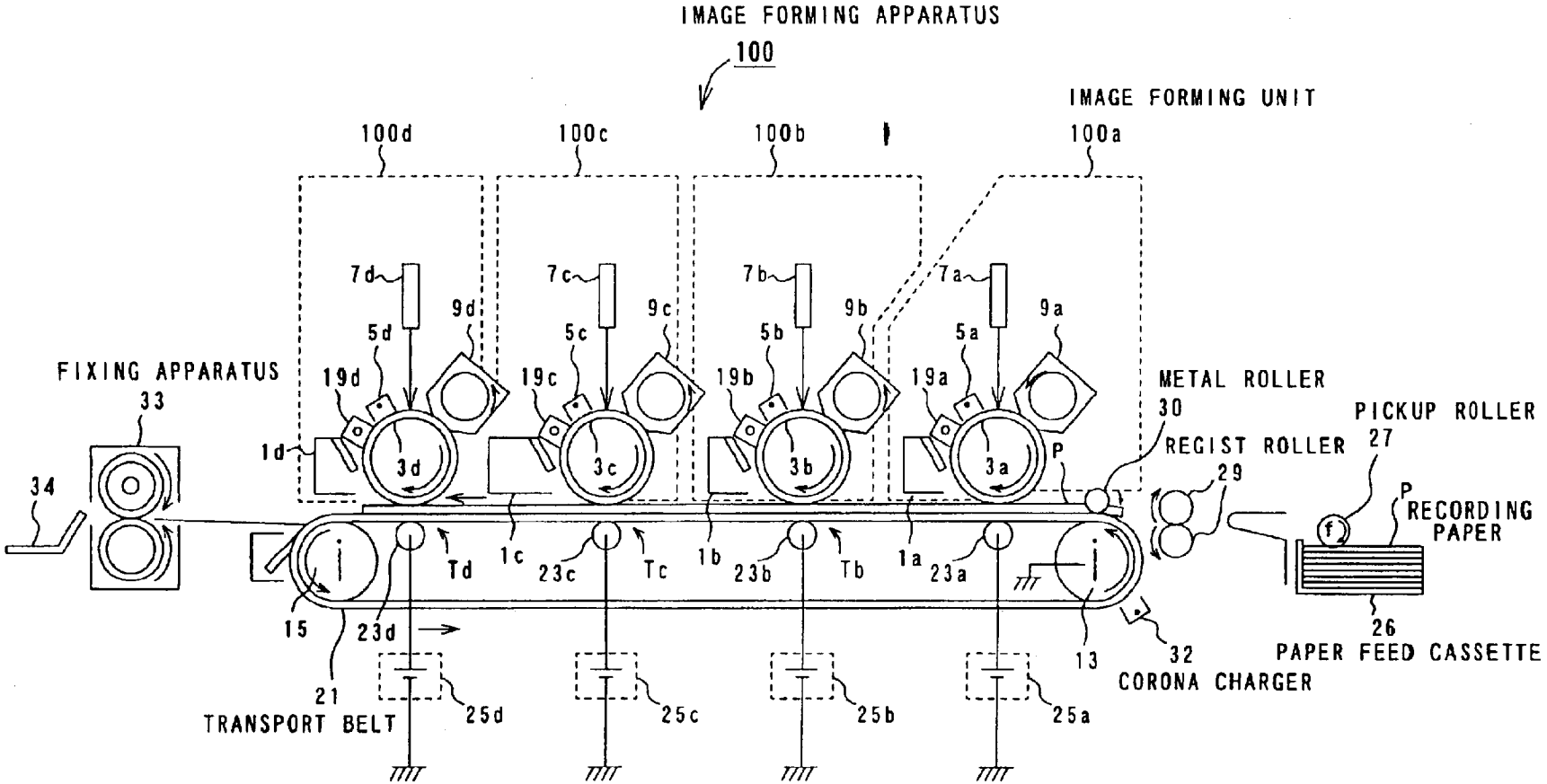
FIG. 1 is a block diagram showing a first embodiment of an image forming apparatus according to the present invention.

An image forming apparatus 100 in FIG. 1 is a 4-drum tandem cleanerless image forming apparatus that uses a photoconductor drum as a photoconductor for forming color images. The image forming apparatus 100 is provided with image forming units 100*a*, 100*b*, 100*c*, and 100*d* for forming yellow (Y), magenta (M), cyan (c), and black (Bk) images. The image forming units 100*a*, 100*b*, 100*c*, and 100*d* are provided with photoconductor drums 3*a*, 3*b*, 3*c*, and 3*d*, respectively. Around these drums, there are arranged adhered toner film cleaners 1*a*, 1*b*, 1*c*, and 1*d*, destaticization lamps 19*a*, 19*b*, 19*c*, and 19*d*, chargers 5*a*, 5*b*, 5*c*, and 5*d*, photoconducting apparatuses 7*a*, 7*b*, 7*c*, and 7*d*, and developing machines 9*a*, 9*b*, 9*c*, and 9*d*. Below the image forming units 100*a*, 100*b*, 100*c*, and 100*d*, there is arranged a transport belt 21 that is hung between a driven roller 13 and a driving roller 15 and rotates endlessly.

In the above-mentioned configuration, the transport belt 21 is approximately equal as wide as the photoconductor drum. An appropriate tension is applied to the transport belt 21 so that it does not slip out of the driving roller 15. The transport belt 21 is made of polyimide having thickness of 100 m over which carbon is spread uniformly for optimal transfer effects. The transport belt 21 is given semi-conductivity having an electric resistance of $10^{10}$ cm. A material for the transport belt 21 just needs to provide semi-conductivity indicating a volume resistance value of $10^{8}$ to $10^{13}$ cm. In addition to the polyimide spread with carbon, it may be preferable to use polyethylene terephthalate, polycarbonate, polytetrafluoro-ethylene, poly (vinylidene fluoride), and the like spread with conductive particles such as carbon. Without using conductive particles, it may be preferable to use a high-polymer film with the adjusted electric resistance by adjusting compositions. Further, it may be preferable to use such high-polymer film mixed with an ionic conductive material or a rubber material such as silicone rubber or urethane rubber with a relatively low electric resistance.

Near an upstream end of the transport belt 21, there are arranged a paper feed cassette 26 containing recording paper P; a pickup roller 27 to pick up one sheet of recording paper P at a time from the paper feed cassette 26; and a regist roller pair 29 to place the recording paper P picked up by the pickup roller 27 on the transport belt 21. On the transport belt 21 at its upstream end, there are arranged a metal roller 30 and a corona charger 32. The metal roller 30 is charged to a ground potential and electrostatically absorbs the recording paper P supplied from the resist roller pair 29 onto the transport belt 21. The corona charger 32 transforms the driven roller 13 into a reverse electrode for charging the transport belt 21 and absorbing the recording paper P.

There are arranged transfer rollers 23*a*, 23*b*, 23*c*, and 23*d* below the photoconductor drums 3*a*, 3*b*, 3*c*, and 3*d*, correspondingly thereto through an intermediate of the transport belt 21. There are arranged DC power supplies 25*a*, 25*b*, 25*c*, and 25*d* to supply positive DC voltages to the transfer rollers 23*a*, 23*b*, 23*c*, and 23*d*, respectively. Near the downstream end of the transport belt 21, there are arranged a fixing apparatus 33 and an output tray 34. The fixing apparatus 33 fixes a toner image formed with developer on the recording paper P ejected from the transport belt 21. The output tray 34 receives and stacks the fixed recording paper P.

The following describes operations of the image forming apparatus in FIG. 1 including detailed description of the above-mentioned image forming units. When an instruction is issued to form an image from an operation panel (not shown) of the image forming apparatus 100, the photoconductor drum 3*a* is driven by a drive mechanism (not shown) to start rotating. The charger 5*a* evenly charges the rotating photoconductor drum 3*a* to, e.g., −600 V. The photoconducting apparatus 7*a* irradiates light corresponding to image information to be recorded onto the evenly charged photoconductor drum 3*a* to form an electrostatic latent image on the surface of the photoconductor drum 3*a*. The developing machine 9*a* uses the developer (including the yellow toner) to develop the electrostatic latent image and forms a yellow toner image. In the same manner as the image forming unit 100*a* forms a toner image on the photoconductor drum 3*a*, the image forming units 100*b*, 100*c*, and 100*d* also form magenta, cyan, and black toner images on the photoconductor drums 3*b*, 3*c*, and 3*d*.

In the meantime, the pickup roller 27 takes the recording paper P from the paper feed cassette 26. The resist roller pair 29 supplies the picked up recording paper P onto the transport belt 21. The recording paper P supplied from the resist roller pair 29 is absorbed on the transport belt 21 by the metal roller 30 and the corona charger 32, and is transported so that it passes under the photoconductor drums 3*a*, 3*b*, 3*c*, and 3*d* sequentially. The photoconductor drums 3*a*, 3*b*, 3*c*, and 3*d* respectively face to the transfer rollers 23*a*, 23*b*, 23*c*, and 23*d* to create transfer areas Ta, Tb, Tc, and Td. The photoconductor drums 3*a*, 3*b*, 3*c*, and 3*d* transfer toner images to the recording paper P transported by the transport belt 21 each time the recording paper P reaches the transfer areas Ta, Tb, Tc, and Td. In this case, the DC power supplies 25*a*, 25*b*, 25*c*, and 25*d* apply positive DC bias voltages to the transfer rollers 23*a*, 23*b*, 23*c*, and 23*d*. Transfer electric fields for transfer are formed between the photoconductor drums 3*a*, 3*b*, 3*c*, and 3*d*, and the transfer rollers 23*a*, 23*b*, 23*c*, and 23*d*.

In the above-mentioned case, for example, the transfer rollers 23*a*, 23*b*, 23*c*, and 23*d* are applied with DC voltages of +1000 V, +1200 V, +1400 V, and +1600 V, respectively. This generates an effect of the transfer electric field, causing a yellow toner image to be transferred to the recording paper P at the transfer area Ta. After the yellow image is transferred, the recording paper P is transported to the transfer area Tb. A magenta toner image is overlappingly transferred onto the recording paper P where the yellow toner image is transferred. The recording paper P is sequentially transported to the transfer areas Tc and Td. Further, cyan and black toner images are sequentially transferred onto the recording paper P where the yellow and magenta toner images are already transferred. After the four colors of toner images are transferred in this manner, the recording paper P is passed to the fixing apparatus 33 for fixing from the transport belt 21, and then is ejected to the output tray 34.

The transfer rollers 23*a*, 23*b*, 23*c*, and 23*d* are made of, e.g., conductive urethane foam whose conductivity is obtained by spreading carbon. As a structure example, the transfer rollers 23*a*, 23*b*, 23*c*, and 23*d* are each created by inserting a cored bar having a diameter of 10 mm into a roller having a diameter of 18 mm exteriorly. There is an electric resistance of approximately $10^6$ between the cored bar and the roller surface. The cored bar is connected with the above-mentioned constant voltage DC power supply. In this case, the transfer rollers 23*a*, 23*b*, 23*c*, and 23*d* may be shaped not only to be a roller, but also to be a conductive brush, conductive rubber blade, or conductive sheet. The conductive sheet is a rubber material or a resin film spread with carbon and may be made of silicone rubber, urethane rubber, EPDM, or polycarbonate. The preferable volume resistance value is $10^5$ to $10^7$ cm. A spring is attached to each of both ends of each of the transfer rollers 23*a*, 23*b*, 23*c*, and 23*d*. The spring applies force to each of the transfer rollers 23*a*, 23*b*, 23*c*, and 23*d* so as to press the rear of the transport belt 21 (approximately 600 gft).

Figure 2A:
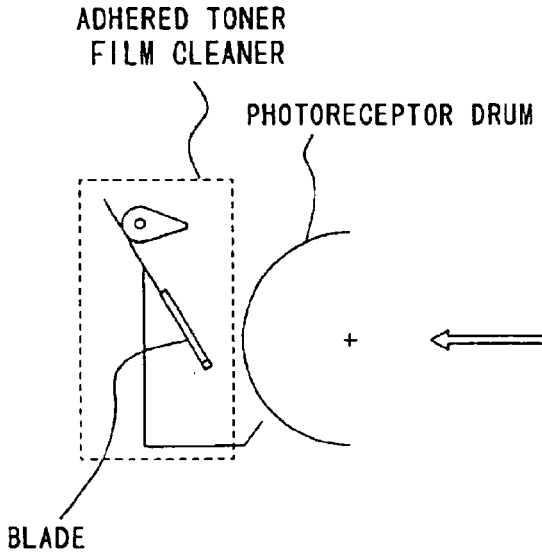
FIGS. 2A and 2B explain a cleaning operation of an adhered toner film cleaner of the image forming apparatus in FIG. 1.
Figure 2B:
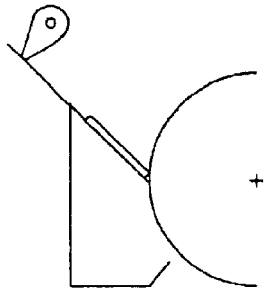

After completion of the transfer, the surfaces of the photoconductor drums 3*a*, 3*b*, 3*c*, and 3*d* move to positions of the adhered toner film cleaners 1*a*, 1*b*, 1*c*, and 1*d*. Normally, blades of the adhered toner film cleaners 1*a*, 1*b*, 1*c*, and 1*d* are detached from surfaces of the photoconductor drums 3*a*, 3*b*, 3*c*, and 3*d* as shown in FIG. 2A. At a timing when the cleaning becomes needed, a cam (or a gear may be used) is driven to press the blades thereof to the surfaces of the photoconductor drums 3*a*, 3*b*, 3*c*, and 3*d* as shown in FIG. 2B. (For example, that timing takes effect when the number of sheets for image formation reaches a predetermined value. This cleaning timing may be determined so that it is activated at a power-on sequence or at a specified interval. Alternatively, an effective interval of the cleaning timing may be decreased as the number of sheets for image formation increases.) When pressed, the blades of the adhered toner film cleaners 1*a*, 1*b*, 1*c*, and 1*d* prevent toner remaining on the surfaces of the photoconductor drums 3*a*, 3*b*, 3*c*, and 3*d* from being adhered to the surfaces thereof to form a toner film. The cleaning timing is preferable when no image is formed.

In the above-mentioned case, the cleaning timings for the adhered toner film cleaners 1*a*, 1*b*, 1*c*, and 1*d* may or may not simultaneously occur between the photoconductor drums 3*a*, 3*b*, 3*c*, and 3*d*. While the blade is used for the adhered toner film cleaners 1*a*, 1*b*, 1*c*, and 1*d*, it may be preferable to use a brush or a rubber roller instead. When the rubber roller is used, it may be rotated for cleaning without generating a cleaning force through rotation of the photoconductor drums 3*a*, 3*b*, 3*c*, and 3*d*. In this example, the adhered toner film cleaners 1*a*, 1*b*, 1*c*, and 1*d* are just mechanically pressed to the photoconductor drums 3*a*, 3*b*, 3*c*, and 3*d* for cleaning. It is also preferable to simultaneously apply voltage for absorbing toner to the adhered toner film cleaners 1*a*, 1*b*, 1*c*, and 1*d*. In this case, the voltage for toner absorption is preferably equivalent to a static voltage having a polarity reverse to that of the toner's static voltage and an AC voltage overlaid therewith.

(Embodiment 2)

Figure 3:
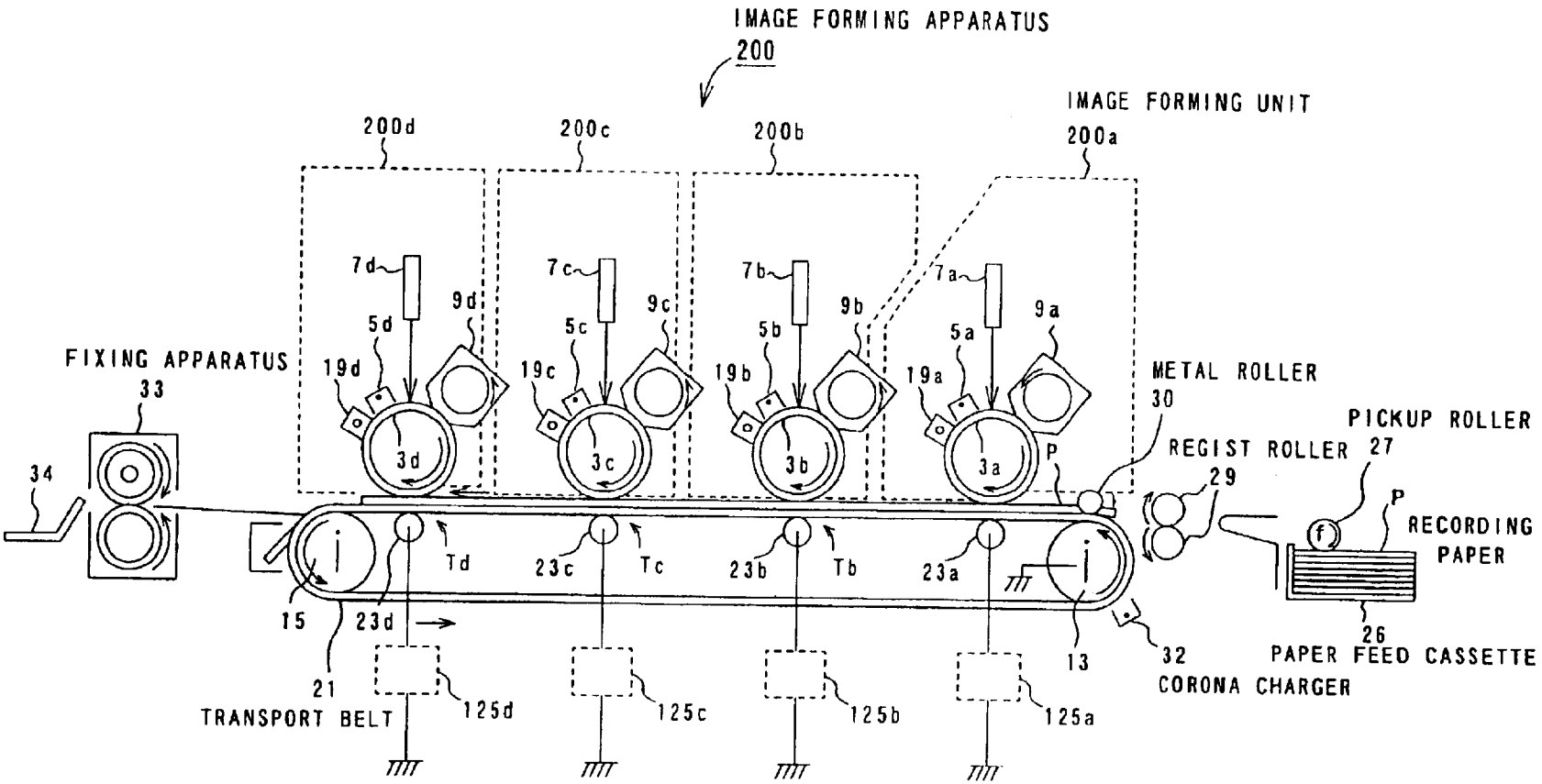
FIG. 3 is a block diagram showing a second embodiment of the image forming apparatus according to the present invention.

FIG. 3 is a block diagram showing a second embodiment of the image forming apparatus according to the present invention. An image forming apparatus 200 is a modification of the image forming apparatus 100 in FIG. 1. Image forming units 200*a*, 200*b*, 200*c*, and 200*d* are provided instead of the image forming units 100*a*, 100*b*, 100*c*, and 100*d*. The image forming units 200*a*, 200*b*, 200*c*, and 200*d* do not have the adhered toner film cleaners 1*a*, 1*b*, 1*c*, and 1*d*. The image forming units 200*a*, 200*b*, 200*c*, and 200*d* have filming prevention power supplies 125*a*, 125*b*, 125*c*, and 125*d* instead of the DC power supplies 25*a*, 25*b*, 25*c*, and 25*d*. During a normal image formation process, the filming prevention power supplies 125*a*, 125*b*, 125*c*, and

125*d* operate like the DC power supplies 25*a*, 25*b*, 25*c*, and 25*d* in FIG. 1. At the cleaning timing, however, the filming prevention power supplies overlay the normal DC voltage on an AC voltage (400 to 2000 Vpp at frequency of 1 to 8 kHz, or more preferably, 1400 Vpp at frequency of 4 kHz). As a result, a vibration force is applied to toners on the photoconductor drums 3*a*, 3*b*, 3*c*, and 3*d*. This causes the toners remaining on the surfaces of the photoconductor drums 3*a*, 3*b*, 3*c*, and 3*d* to be separated therefrom and to be moved onto the recording paper P.

(Embodiment 3)

In addition to the foregoing, the following method is also available. As the third embodiment, for example, a cleaning sheet, instead of the recording paper, is mounted on the transport belt 21 and is fed under the photoconductor drums 3*a*, 3*b*, 3*c*, and 3*d*. It is preferable to impregnate the cleaning sheet with organic solvent such as alcohol or form an adhesive layer on the surface. It is preferable to determine the cleaning time when the power is turned on or a maintenance work is conducted.

(Embodiments 4, 5, and 6)

Further, as the fourth embodiment, the polymerization method or the melting and suspending granulation method is used to create encapsulated toner containing wax (e.g., using a polyester material) which is then used as a component of the developer. This method can suppress adhesion of the toner to the photoconductor as much as possible.

The fifth embodiment uses toner containing, as an additive, wax with a melting point of 100° C. or higher. Available additive materials include urethane compound wax (melting point 104° C.), fatty monoamides carbonic acid (110° C.), and ethylene bis-stearic acid amide (142° C.).

Figure 4:
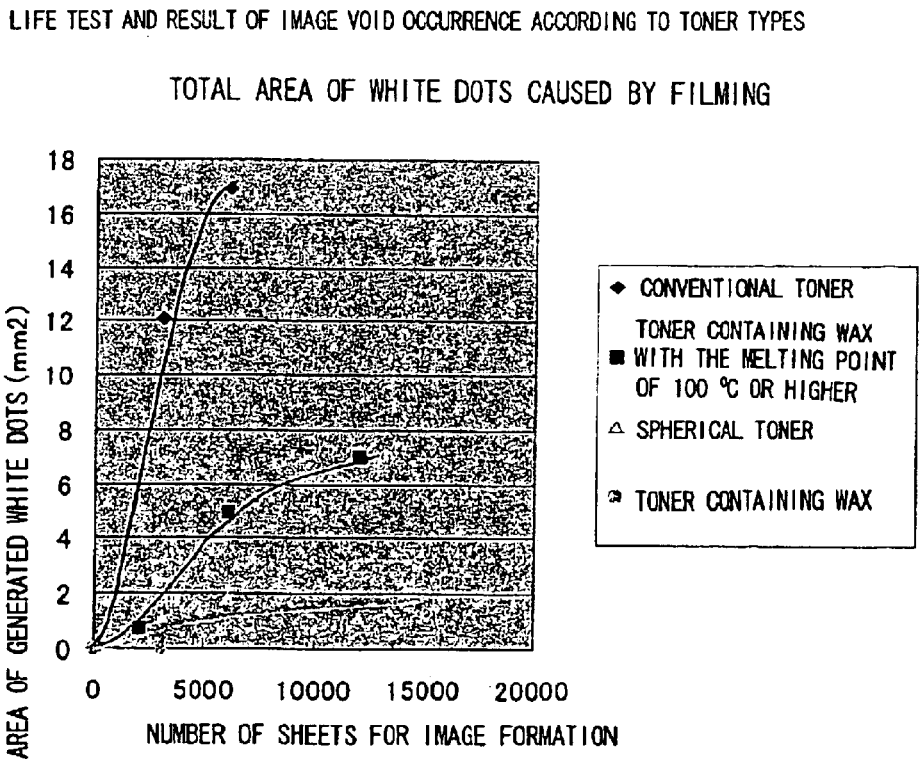
FIG. 4 is a graph explaining effects of fourth through sixth embodiments of the image forming apparatus according to the present invention.

Moreover, the sixth embodiment provides a method of using spherical toner as a developer component. Such toner can be created through the polymerization method or the heat re-treatment of pulverized toner. According to this method, the spherical toner is easily separated from the photoconductor (providing high releasability) and effectively prevents occurrence of filming. FIG. 4 shows comparison among effects of using the conventional toner and the other toners according to the above-mentioned fourth to sixth embodiments. That is to say, the toners according to the fourth to sixth embodiments provide very improved results in the total area of white dots caused by filming with reference to the number of sheets for forming images.

(Embodiment 7)

Figure 5:
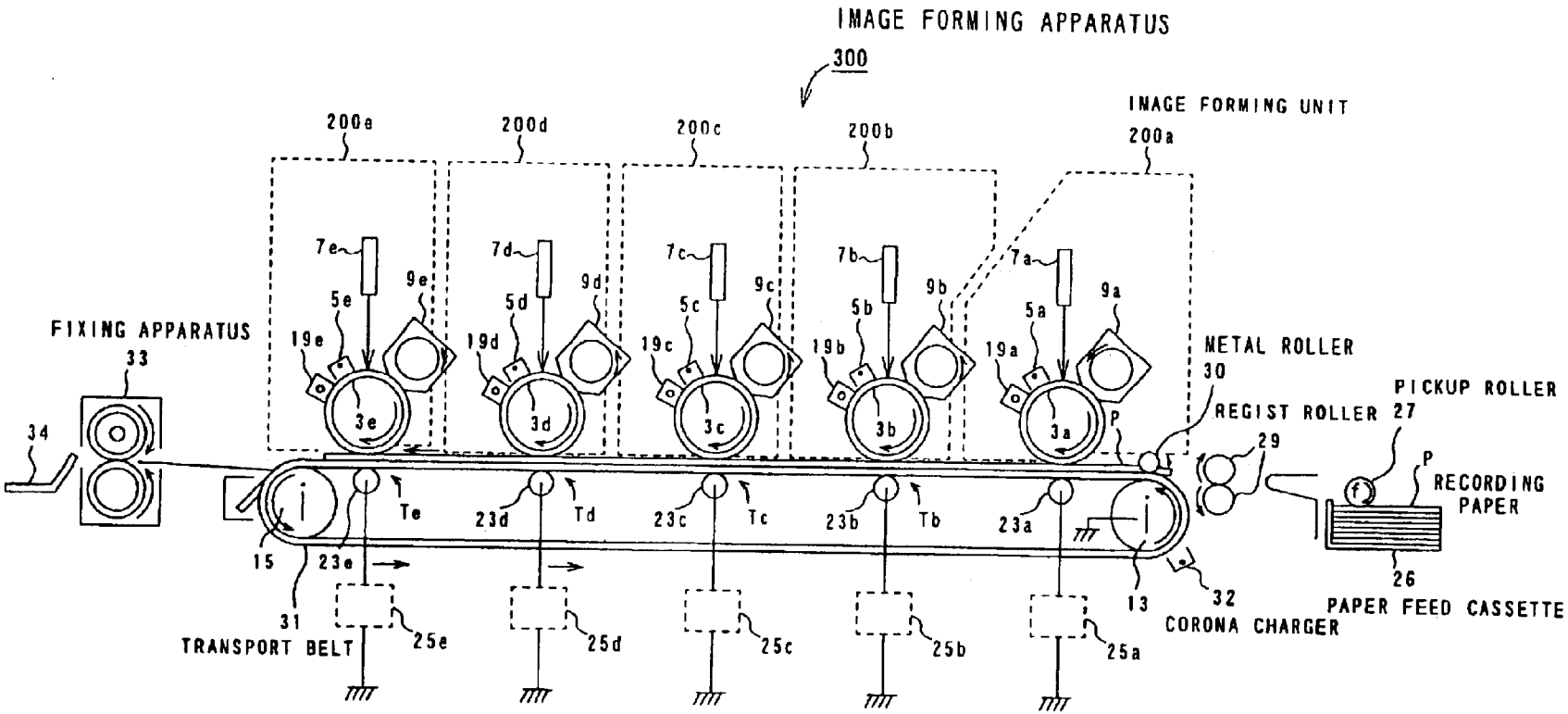
FIG. 5 is a block diagram showing a seventh embodiment of the image forming apparatus according to the present invention.

FIG. 5 is a block diagram showing the seventh embodiment of the image forming apparatus according to the present invention. An image forming apparatus 300 is a modification of the image forming apparatus 200 in FIG. 3 and provides five image forming units 200*a*, 200*b*, 200*c*, 200*d*, and 200*e*. For this reason, a transport belt 31 is longer than the transport belt 21 in FIG. 3. Of the image forming units 200*a*, 200*b*, 200*c*, 200*d*, and 200*e*, the four image forming units 200*a*, 200*b*, 200*c*, and 200*d* have substantially the same structure as that of the image forming units 200*a*, 200*b*, 200*c*, and 200*d* in FIG. 3, and use toners with no wax added. The remaining image forming unit 200*e* has the same structure as that of the above-mentioned units but uses toner that contains resin and wax with no color pigment contained. In this configuration, the image forming unit 200*e* is used to form a wax layer on the recording paper in advance. On this recording paper P where the wax layer is formed, the subsequent process uses the four image forming units 200*a*, 200*b*, 200*c*, and 200*d* to form images. Accordingly, it is possible to suppress adhesion of toners to the photoconductor.

(Embodiment 8)

Figure 6:
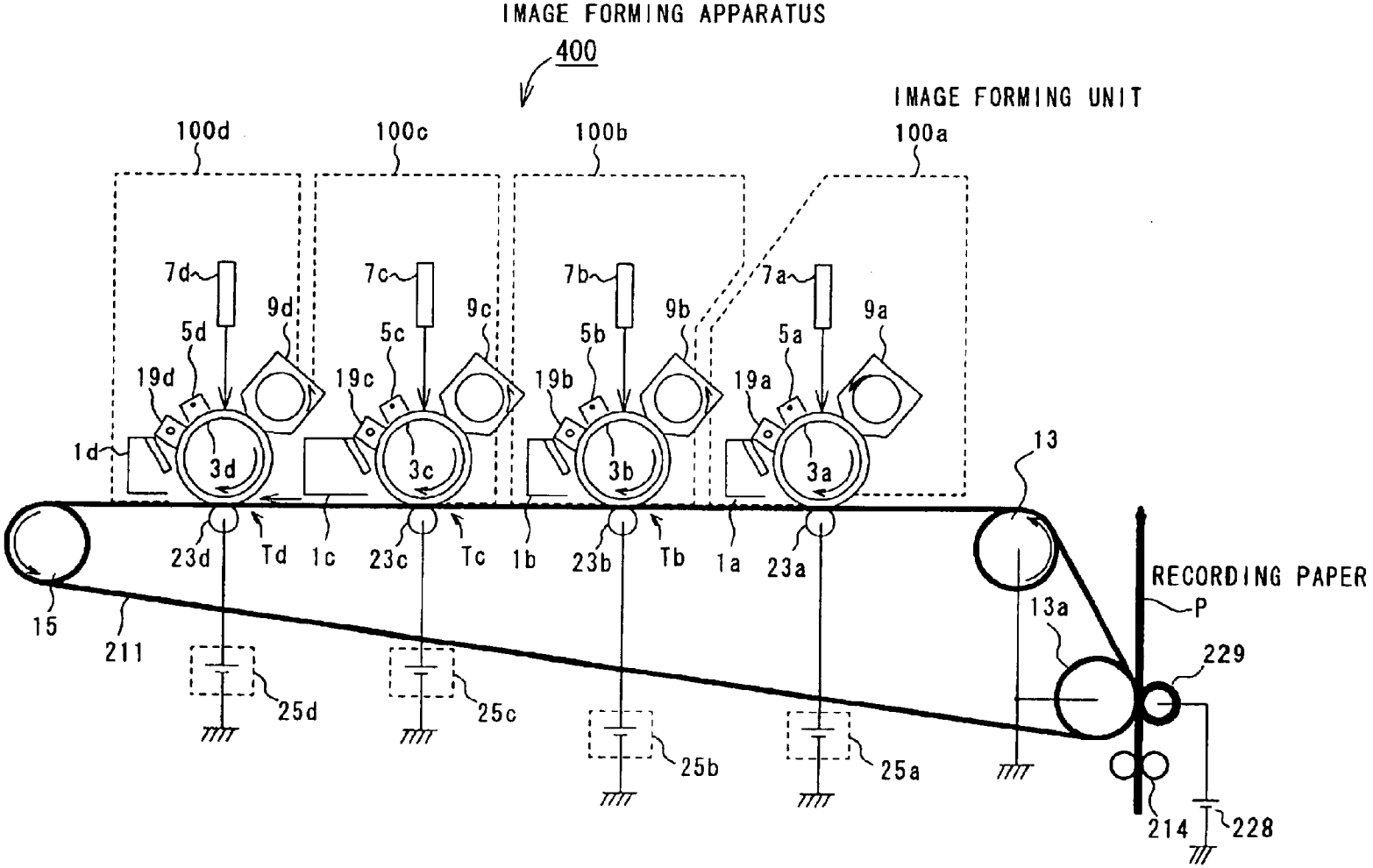
FIG. 6 is a block diagram showing an eighth embodiment of the image forming apparatus according to the present invention.

FIG. 6 is a block diagram showing the eighth embodiment of the image forming apparatus according to the present invention. An image forming apparatus 400 is a modification of the image forming apparatus in FIG. 1. Instead of the transport belt, an intermediate transfer belt 211 is hung among rollers 13, 13*a*, and 15. The photoconductor drums 3*a*, 3*b*, 3*c*, and 3*d*, and the transfer rollers 23*a*, 23*b*, 23*c*, and 23*d* form a toner image on the intermediate transfer belt 211. The toner image formed on the intermediate transfer belt 211 is subject to timing adjustment by means of an aligning roller 214 and is transferred to the recording paper P (secondary transfer) fed between the roller 13*a* and a secondary transfer roller 229.

In this case, the secondary transfer roller 229 is supplied with DC voltage for the secondary transfer from a power supply 228. Also in this case, like the example in FIG. 1, the adhered toner film cleaners 1*a*, 1*b*, 1*c*, and 1*d* clean the surfaces of the photoconductor drums 3*a*, 3*b*, 3*c*, and 3*d* at every cleaning timing to prevent filming, i.e., generating a toner film through adhesion of toners on the surfaces of the photoconductor drums 3*a*, 3*b*, 3*c*, and 3*d*.

(Embodiment 9)

Figure 7:
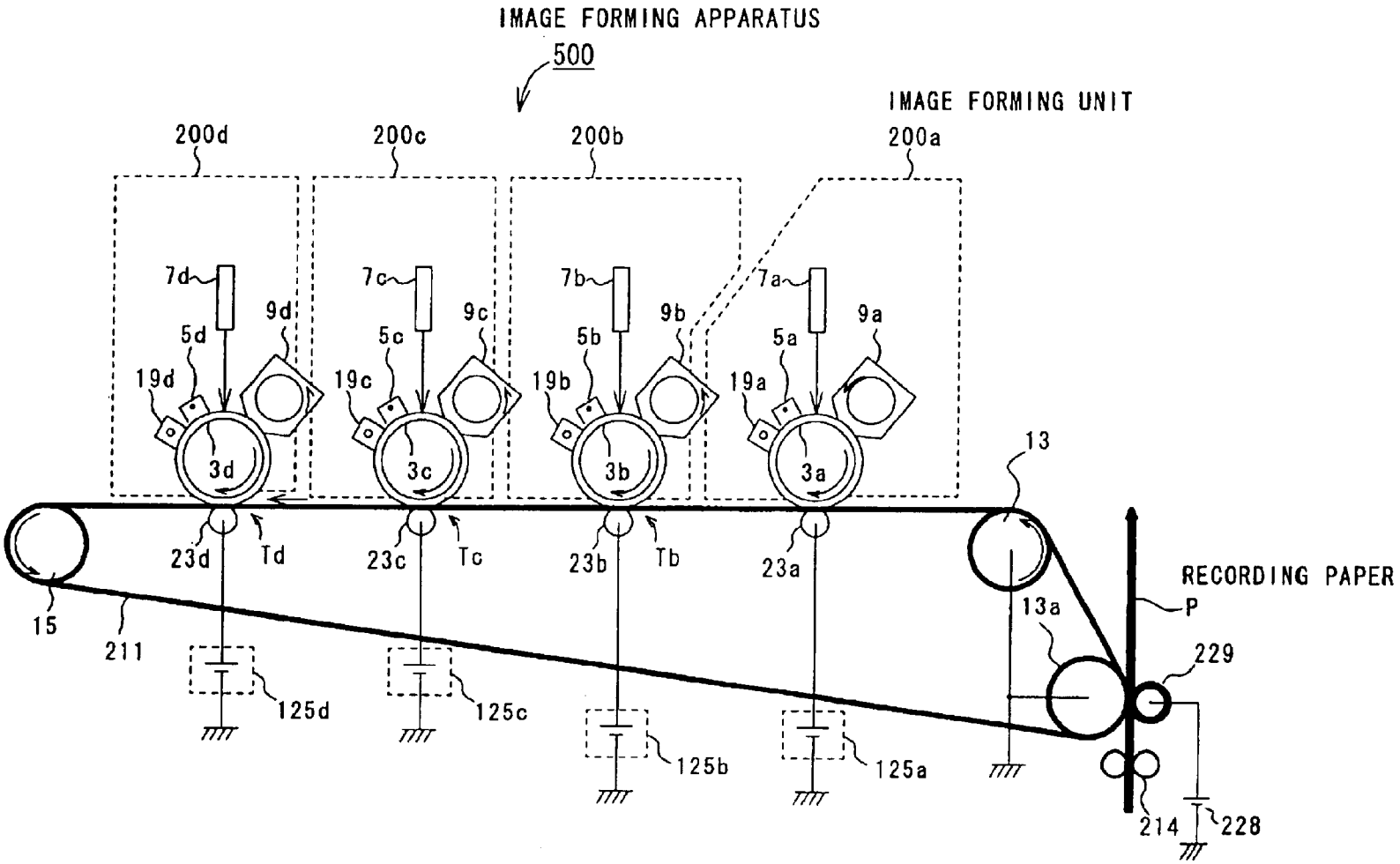
FIG. 7 is a block diagram showing a ninth embodiment of the image forming apparatus according to the present invention.

FIG. 7 is a block diagram showing the ninth embodiment of the image forming apparatus according to the present invention. An image forming apparatus 500 is a modification of the image forming apparatus in FIG. 3. Instead of the transport belt, the intermediate transfer belt 211 is hung among the rollers 13, 13*a*, and 15. Like FIG. 6, the photoconductor drums 3*a*, 3*b*, 3*c*, and 3*d*, and the transfer rollers 23*a*, 23*b*, 23*c*, and 23*d* form a toner image on the intermediate transfer belt 211, and the like. Like the image forming apparatus 200 in FIG. 3, however, the image forming apparatus 500 has filming prevention power supplies 125*a*, 125*b*, 125*c*, and 125*d* instead of the adhered toner film cleaners 1*a*, 1*b*, 1*c*, and 1*d*. Therefore, the image forming apparatus 500 provides the same advantage as that of the image forming apparatus 200 in FIG. 3.

While there have been described various embodiments, it is obvious that each of these embodiments may be implemented independently. In addition, it is also preferable to combine some of them. For example, it is possible to combine the first embodiment with one of the fourth to sixth embodiments. Obviously, the third embodiment can be combined with any of the other embodiments. It is preferable to combine the first embodiment with the second embodiment. Moreover, with this combination, it is possible to combine one of the fourth to sixth embodiments. That is to say, it is preferable to appropriately combine and implement the above-mentioned methods as needed if no technical contradiction results. While no description has been given to the transfer drum system that forms a 4-color toner image through four rotations of the transfer drums, it is obvious that it is possible to apply the same principle as employed for the above-mentioned embodiments.

The image forming apparatus according to the present invention is configured as mentioned above. During a normal operation, the cleanerless image forming apparatus having the adhered toner film cleaner does not mechanically clean the photoconductor. Only at every cleaning timing activated at a given time interval, the adhered toner film cleaner is used to mechanically clean the surface of the photoconductor. It is possible to prevent the occurrence of filming without giving much adverse effects on prolonging the cleanerless photoconductor's life. When the filming prevention power supplies are provided, no mechanical change needs to be made to the cleanerless image forming apparatus. It is possible to easily solve the electrical problem by overlaying AC voltage on the transfer roller. If improvements are made to toners used for the image forming apparatus, there is no need for mechanical and electrical changes to the image forming apparatus, making the embodiments easy. If the image forming apparatus includes a wax layer forming unit, preparatory measures are taken for the developer (toner), making it possible to reliably prevent the filming. The method of using the cleaning sheet just needs to feed the cleaning sheet instead of the recording paper, making the implementation very easy. It is obvious that these methods can be combined for implementation.

What is claimed is:

1. An image forming apparatus comprising a plurality of image forming units each forming a toner image of a corresponding color on a photoconductor according to a cleanerless system, wherein each of said image forming units has an adhered toner film cleaner which touches a surface of said photoconductor and simultaneously applies an alternating current voltage to absorb toner from and mechanically cleans said surface at every cleaning timing for cleaning said surface of said photoconductor.

2. The image forming apparatus according to claim 1, wherein said photoconductor of each of said image forming units cooperates with a transfer roller and overlappingly transfers said formed toner images sequentially on recording paper supplied by said transport belt.

3. The image forming apparatus according to claim 1, wherein said photoconductor of each of said image forming units cooperates with a transfer roller, overlappingly transfers said formed toner images sequentially on an intermediate transfer belt, and then collectively transfers overlappingly transferred toner images on recording paper.

4. An image forming apparatus comprising a plurality of image forming units each forming a toner image of a corresponding color on a photoconductor according to a cleanerless system, wherein said photoconductor of each of said image forming units cooperates with a transfer roller and overlappingly transfers said formed toner images sequentially on recording paper supplied by a transport belt, said apparatus further comprising:

a filming prevention power supply capable of overlaying AC voltage for filming prevention on transfer-use DC voltage applied to said transfer roller at every cleaning timing for cleaning said surface of said photoconductor.

5. The image forming apparatus according to claim 4, wherein said AC voltage has a frequency in the range from about one to about eight kilohertz.

6. The image forming apparatus according to claim 5, wherein said AC voltage has a frequency of about four kilohertz.

7. The image forming apparatus according to claim 4, wherein said AC voltage has a voltage peak to peak in the range from about 400 to about 2000 volts.

8. The image forming apparatus according to claim 7, wherein said AC voltage has a voltage peak to peak of about 1400 volts.

9. An image forming apparatus comprising a plurality of image forming units each forming a toner image of a corresponding color on a photoconductor according to a cleanerless system, wherein said photoconductor of each of said image forming units cooperates with a transfer roller, overlappingly transfers said formed toner images on an intermediate transfer belt, and then collectively transfers overlappingly transferred toner images sequentially to recording paper, said apparatus further comprising:

a filming prevention power supply capable of overlaying AC voltage for filming prevention on transfer-use DC voltage applied to said transfer roller at every cleaning timing for cleaning said surface of said photoconductor.

10. The image forming apparatus according to claim 9, wherein said AC voltage has a frequency in the range from about one to about eight kilohertz.

11. The image forming apparatus according to claim 10, wherein said AC voltage has a frequency of about four kilohertz.

12. The image forming apparatus according to claim 9, wherein said AC voltage has a voltage peak to peak in the range from about 400 to about 2000 volts.

13. The image forming apparatus according to claim 7, wherein said AC voltage has a voltage peak to peak of about 1400 volts.

14. An image forming apparatus comprising a plurality of image forming units each forming a toner image of a corresponding color on a photoconductor according to a cleanerless system, wherein each of said image forming units has an adhered toner film cleaner which touches a surface of said photoconductor and simultaneously applies an alternating current voltage to absorb toner from and mechanically cleans said surface at every cleaning timing for cleaning said surface of said photoconductor, and wherein said photoconductor of each of said image forming units cooperates with a transfer roller and overlappingly transfers said formed toner images sequentially on recording paper supplied by a transport belt, said apparatus further comprising:

a filming prevention power supply capable of overlaying AC voltage for filming prevention on transfer-use DC voltage applied to said transfer roller at every cleaning timing for cleaning said surface of said photoconductor.

15. An image forming apparatus comprising a plurality of image forming units each forming a toner image of a corresponding color on a photoconductor according to a cleanerless system, wherein each of said image forming units has an adhered toner film cleaner which touches a surface of said photoconductor and simultaneously applies an alternating current voltage to absorb toner from and mechanically cleans said surface at every cleaning timing for cleaning said surface of said photoconductor, wherein said photoconductor of each of said image forming units cooperates with a transfer roller and overlappingly transfers said formed toner images sequentially on recording paper supplied by a transport belt, and wherein said apparatus is configured for feeding a cleaning sheet instead of said recording paper at every cleaning timing for cleaning a surface of said photoconductor.

16. An image forming apparatus comprising a plurality of image forming units each forming a toner image of a corresponding color on a photoconductor according to a cleanerless system, wherein said photoconductor of each of said image forming units cooperates with a transfer roller and overlappingly transfers said formed toner images sequentially on recording paper supplied by a transport belt, wherein said apparatus is configured for feeding a cleaning sheet instead of said recording paper at every cleaning timing for cleaning a surface of said photoconductor, said apparatus further comprising:

a filming prevention power supply capable of overlaying AC voltage for filming prevention on transfer-use DC voltage applied to said transfer roller at every cleaning timing for cleaning said surface of said photoconductor.

17. An image forming apparatus comprising a plurality of image forming means each for forming a toner image of a corresponding color on a photoconductor according to a cleanerless system, comprising:

an adhered toner film cleaning means for touching a surface of said photoconductor and simultaneously applying an alternating current voltage to absorb toner from and mechanically cleaning said surface at every cleaning timing for cleaning said surface of said photoconductor.

18. An image forming apparatus comprising a plurality of image forming means each for forming a toner image of a corresponding color on a photoconductor according to a cleanerless system, comprising:

transfer means for overlappingly transferring said formed toner images sequentially on recording paper; and a filming prevention means for overlaying AC voltage for filming prevention on transfer-use DC voltage applied to said transfer means at every cleaning timing for cleaning said surface of said photoconductor.

19. An image forming apparatus comprising a plurality of image forming means each for forming a toner image of a corresponding color on a photoconductor according to a cleanerless system, comprising:

transfer means for overlappingly transferring said formed toner images on an intermediate transfer belt, and then collectively transferring overlappingly transferred toner images sequentially to recording paper; and a filming prevention means for overlaying AC voltage for filming prevention on transfer-use DC voltage applied to said transfer means at every cleaning timing for cleaning said surface of said photoconductor.

20. An image forming apparatus comprising a plurality of image forming means each for forming a toner image of a corresponding color on a photoconductor according to a cleanerless system, comprising:

an adhered toner film cleaning means for touching a surface of said photoconductor and simultaneously applying an alternating current voltage to absorb toner from and mechanically cleaning said surface at every cleaning timing for cleaning said surface of said photoconductor;

transfer means for overlappingly transferring said formed toner images sequentially on recording paper; and a filming prevention means for overlaying AC voltage for filming prevention on transfer-use DC voltage applied to said transfer means at every cleaning timing for cleaning said surface of said photoconductor.

21. An image forming apparatus comprising a plurality of image forming means each for forming a toner image of a corresponding color on a photoconductor according to a cleanerless system, comprising:

an adhered toner film cleaning means for touching a surface of said photoconductor and simultaneously applying an alternating current voltage to absorb toner from and mechanically cleaning said surface at every cleaning timing for cleaning said surface of said photoconductor;

transfer means for overlappingly transferring said formed toner images sequentially on recording paper, and feeding means for feeding a cleaning sheet instead of said recording paper at every cleaning timing for cleaning a surface of said photoconductor.

22. An image forming apparatus comprising a plurality of image forming means each for forming a toner image of a corresponding color on a photoconductor according to a cleanerless system, comprising:

transfer means for overlappingly transferring said formed toner images sequentially on recording paper;

feeding means for feeding a cleaning sheet instead of said recording paper at every cleaning timing for cleaning a surface of said photoconductor; and a filming prevention means for overlaying AC voltage for filming prevention on transfer-use DC voltage applied to said transfer roller at every cleaning timing for cleaning said surface of said photoconductor.

* * * * *